US012233464B2

(12) United States Patent
Yang et al.

(10) Patent No.: US 12,233,464 B2
(45) Date of Patent: Feb. 25, 2025

(54) METHOD FOR PRODUCING NICKEL NANOPOWDER AND NICKEL NANOPOWDER PRODUCED USING SAME

(71) Applicant: KOREA INSTITUTE OF INDUSTRIAL TECHNOLOGY, Cheonan (KR)

(72) Inventors: Seung Min Yang, Gangneung (KR); Geon Dae Moon, Yangsan-si (KR); Young Kyu Jeong, Hwaseong (KR); Ohyung Kwon, Gangneung-si (KR); Gun Hee Kim, Incheon (KR); Kyung Hoon Kim, Daejeon (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 0 days.

(21) Appl. No.: 18/247,735

(22) PCT Filed: Aug. 18, 2021

(86) PCT No.: PCT/KR2021/010940
§ 371 (c)(1),
(2) Date: Apr. 3, 2023

(87) PCT Pub. No.: WO2022/075576
PCT Pub. Date: Apr. 14, 2022

(65) Prior Publication Data

US 2023/0415232 A1 Dec. 28, 2023

(30) Foreign Application Priority Data

Oct. 6, 2020 (KR) ..... 10-2020-0128530

(51) Int. Cl.
*B05D 1/00* (2006.01)
*B22F 1/054* (2022.01)
(Continued)

(52) U.S. Cl.
CPC ..... *B22F 9/26* (2013.01); *B22F 1/054* (2022.01); *B22F 1/145* (2022.01); *B22F 1/16* (2022.01);
(Continued)

(58) Field of Classification Search
CPC . B05D 1/00; B22F 1/054; B22F 1/145; B22F 1/16; B22F 9/26; B22F 9/12;
(Continued)

(56) References Cited

U.S. PATENT DOCUMENTS 7,261,761 B2 8/2007 Kagohashi et al.
7,604,679 B2 10/2009 Hattori
(Continued)

FOREIGN PATENT DOCUMENTS

JP H10-88205 A 4/1998
JP 2003-342606 A 12/2003
(Continued)

OTHER PUBLICATIONS

JP-2010174354-A English translation (Year: 2010).*
International Search Report for International Application No. PCT/KR2021/010940, mailed Nov. 24, 2021.

*Primary Examiner* — Hai Y Zhang

(57) ABSTRACT

Provided is a method of producing a nickel nanopowder, the method capable of preventing coagulation between particles and, accordingly, providing a nickel nanopowder having a small average particle size and a low coagulation rate. According to an embodiment of the present invention, the method of producing a nickel nanopowder includes providing a nickel salt and a shell-forming material; nucleating and growing nickel core particles from the nickel salt; forming a shell layer on surfaces of the nickel core particles using the shell-forming material; and removing the shell layer to form the nickel nanopowder.

11 Claims, 13 Drawing Sheets

(51) Int. Cl.
*B22F 1/145* (2022.01)
*B22F 1/16* (2022.01)
*B22F 9/26* (2006.01)

(52) U.S. Cl.
CPC ..... *B22F 2301/15* (2013.01); *B22F 2302/25* (2013.01); *B22F 2304/054* (2013.01); *B22F 2998/10* (2013.01); *B22F 2999/00* (2013.01)

(58) Field of Classification Search
CPC ..... B22F 2301/15; B22F 2302/25; B22F 2998/10; B22F 2999/00
See application file for complete search history.

(56) References Cited

U.S. PATENT DOCUMENTS

| | | | |
|---|---|---|---|
| 7,658,995 | B2 | 2/2010 | Yoshida |
| 9,175,385 | B2 | 11/2015 | Kim |
| 10,505,142 | B2 | 12/2019 | Oh |
| 2005/0268992 | A1 | 12/2005 | Kagohashi |
| 2006/0068217 | A1 | 3/2006 | Mizuno |
| 2008/0305334 | A1 | 12/2008 | Jang |

FOREIGN PATENT DOCUMENTS

| | | | | | |
|---|---|---|---|---|---|
| JP | 2005-336530 | A | | 12/2005 | |
| JP | 2010174354 | A | * | 8/2010 | ..... B22F 1/02 |
| JP | 2015-86413 | A | | 5/2015 | |
| JP | 6000983 | B2 | | 10/2016 | |
| KR | 10-2005-0037594 | A | | 4/2005 | |
| KR | 10-2007-0023814 | A | | 2/2007 | |
| KR | 10-2007-0048595 | A | | 5/2007 | |
| KR | 10-2008-0107578 | A | | 12/2008 | |
| KR | 10-2010-0088528 | A | | 8/2010 | |
| KR | 10-2013-0122102 | A | | 11/2013 | |
| KR | 10-2014-0098513 | A | | 8/2014 | |
| KR | 10-2014-0148193 | A | | 12/2014 | |
| KR | 10-2018-0003329 | A | | 1/2018 | |
| WO | 2004-020128 | A1 | | 3/2004 | |

* cited by examiner

FIG. 4

| | ANIONS | | | | | | | | | | | | | |
|---|---|---|---|---|---|---|---|---|---|---|---|---|---|---|
| CATIONS | Acetate | Bromide | Carbonate | Chloride | Chromate | Fluoride | Hydroxide | Iodide | Nitrate | Oxide | Phosphate | Silicate | Sulfate | Sulfide |
| Aluminum | S | S | ? | S | ? | SS | I | S | S | I | I | I | S | DR |
| Ammonium | S | S | S | S | S | S | S | S | S | ? | S | ? | S | S |
| Barium | S | S | I | S | I | SS | S | S | S | DR | I | S | I | DR |
| Calcium | S | S | I | S | S | I | SS | S | S | DR | I | SS | SS | DR |
| Chromium (III) | S | S | I | S | I | I | I | S | S | I | I | ? | S | DR |
| Cobalt (II) | S | S | I | S | I | S | I | S | S | I | I | I | S | I |
| Copper (II) | S | S | I | S | I | S | I | DR | S | I | I | I | S | I |
| Iron (II) | S | S | I | S | I | SS | I | S | S | I | I | I | S | I |
| Iron (III) | S | S | ? | S | I | SS | I | S | S | I | I | I | SS | DR |
| Lead (II) | S | SS | I | SS | I | I | I | SS | S | I | I | I | I | I |
| Lithium | S | S | SS | S | S | SS | S | S | S | DR | I | I | S | S |
| Magnesium | S | S | I | S | S | I | SS | S | S | I | I | I | S | DR |
| Manganese (II) | DR | S | SS | S | I | S | SS | S | S | I | SS | I | S | SS |
| Manganese (III) | ? | ? | ? | DR | I | DR | I | ? | ? | I | SS | I | DR | I |
| Mercury (I) | SS | I | I | I | I | DR | ? | I | S | I | I | ? | SS | I |
| Mercury (II) | S | SS | I | S | DR | DR | I | I | S | I | I | ? | DR | I |
| Nickel (II) | S | S | I | S | I | S | I | S | S | I | I | ? | S | I |
| Potassium | S | S | S | S | I | S | S | S | S | DR | S | S | S | S |
| Rubidium | S | S | S | S | S | S | S | S | S | DR | ? | ? | S | S |
| Silver | SS | I | I | I | I | S | ? | I | S | I | I | ? | SS | I |
| Sodium | S | S | S | S | S | S | S | S | S | DR | S | S | S | S |
| Strontium | S | S | SS | S | I | I | SS | S | S | DR | I | I | I | I |
| Tin (II) | ? | S | ? | S | I | S | I | S | DR | I | I | ? | S | I |
| Tin (IV) | S | S | ? | ? | S | S | SS | S | DR | I | ? | ? | S | I |
| Zinc | S | S | I | S | I | S | I | S | S | I | I | I | S | I |

METHOD FOR PRODUCING NICKEL NANOPOWDER AND NICKEL NANOPOWDER PRODUCED USING SAME

CROSS REFERENCE TO RELATED APPLICATIONS

The present application is a National Phase of International Application No. PCT/KR2021/010940 filed on Aug. 18, 2021, which claims the priority based on Korean Patent Application No. 10-2020-0128530 filed on Oct. 6, 2020, and the entire contents disclosed in the description and drawings of the corresponding applications are referenced in the present application.

FIELD OF INVENTION

The technical idea of the present invention relates to a metal powder, and more particularly to a method of producing a nickel nanopowder having a uniform particle size by preventing coagulation between particles, and a nickel nanopowder produced using the method.

BACKGROUND OF INVENTION

Multi-Layer Ceramic Capacitor (MLCC), which is a chip-type capacitor that temporarily charges electricity or removes noise in an electronic circuit, is a component that stores current and stably supplies electricity only as needed to ensure the proper operation of electronic devices. In modern times, the demand for the MLCC is so high that it is called rice in the electronics industry, for example, about 1000 MLCCs are needed for personal computers and smartphones, and about 2000 MLCCs are needed for televisions.

Such an MLCC is required to reduce the size thereof and increase the storage capacitance thereof. For this, MLCC has a structure wherein about 500 ceramic layers and nickel electrode layers are alternately stacked thereinside. MLCC is formed through a molding process of forming a ceramic sheet on a release film, a printing process of forming an electrode pattern on the ceramic sheet, and a lamination process of laminating the ceramic sheet and a nickel electrode layer after cutting the ceramic sheet and removing the release film. An important technology in the MLCC is to make a nickel electrode layer as thin as possible and laminate it in large numbers, and to form it without cracking at a high temperature of 1000° C. or higher.

Recently, ultra-thin stratification of internal electrodes has been required with the microminiaturization and high stratification of the MLCC. However, when using a nickel powder according to an existing technology, there is a problem in that disconnection occurs due to oversintering or powders are coagulated.

SUMMARY OF INVENTION

Technical Problem to be Solved

Therefore, the present invention has been made in view of the above problems, and it is one object of the present invention to provide a method of producing a nickel nanopowder having a small average particle size and a low coagulation rate by preventing coagulation between particles, and a nickel nanopowder produced using the method.

It will be understood that the technical problems are only provided as examples, and the scope of the present invention is not limited thereto.

Technical Solution

In accordance with an aspect of the present invention, the above and other objects can be accomplished by the provision of a method of producing a nickel nanopowder, the method capable of preventing coagulation between particles and, accordingly, providing a nickel nanopowder having a small average particle size and a low coagulation rate, and a nickel nanopowder produced using the method.

In accordance with an embodiment of the present invention, the method of producing a nickel nanopowder may include providing a nickel salt and a shell-forming material; nucleating and growing nickel core particles from the nickel salt; forming a shell layer on surfaces of the nickel core particles using the shell-forming material; and removing the shell layer to form the nickel nanopowder.

In accordance with an embodiment of the present invention, the shell layer may induce non-sintering-type coagulation of the nickel core particles, and the non-sintering-type coagulated nickel core particles may be individualized as the shell layer is removed, thereby forming the nickel nanopowder.

In accordance with an embodiment of the present invention, in the providing, the nickel salt and the shell-forming material may be provided by vaporizing at 300° C. to 1200° C.

In accordance with an embodiment of the present invention, in the providing, the nickel salt and the shell-forming material may be provided in a weight ratio of 3:1 to 65:1.

In accordance with an embodiment of the present invention, in the providing, the shell-forming material may be provided in a range of 0.4 mmol/L to 2.5 mmol/L in a molar ratio per the volume of an injection gas.

In accordance with an embodiment of the present invention, in the nucleating and growing, the nickel salt may be reduced using a reducing gas, thereby forming the nickel core particles in a solid phase.

In accordance with an embodiment of the present invention, the nucleating and growing may be performed at 800° C. to 1200° C.

In accordance with an embodiment of the present invention in the forming, a vaporized shell-forming material may be precipitated and grown on surfaces of the nickel core particles to form the shell layer.

In accordance with an embodiment of the present invention, the forming may be performed in an area where temperature decreases according to a direction in which the nickel core particles are transported.

In accordance with an embodiment of the present invention, the forming may be performed at 300° C. to 1200° C.

In accordance with an embodiment of the present invention, in the forming, a free energy of formation of the shell-forming material may be smaller than a free energy of formation of the nickel salt.

In accordance with an embodiment of the present invention, in the forming, the shell-forming material may have an equilibrium vapor pressure of 0.9 kPa to 54 kPa.

In accordance with an embodiment of the present invention, in the removing, the shell layer may be selectively removed through wet post-processing.

In accordance with an embodiment of the present invention, the nickel salt may include at least one of nickel acetate, nickel bromide, nickel carbonate, nickel chloride, nickel fluoride, nickel hydroxide, nickel iodide, nickel nitrate, nickel oxide, nickel phosphate, nickel silicate, nickel sulfate, and nickel sulfide.

In accordance with an embodiment of the present invention, the shell-forming material may include a water-soluble metal salt.

In accordance with an embodiment of the present invention, the shell-forming material may include at least one of aluminum (Al), barium (Ba), calcium (Ca), chromium (Cr), cobalt (Co), copper (Cu), iron (Fe), lead (Pb), lithium (Li), magnesium (Mg), manganese (Mn), mercury (Hg), nickel (Ni), potassium (K), rubidium (Rb), silver (Ag), sodium (Na), strontium (Sr), tin (Sn), lanthanum (La), silicon (Si), gallium (Ga), scandium (Sc), titanium (Ti), vanadium (V), zirconium (Zr), yttrium (Y), cadmium (Cd), actinium (Ac), cesium (Cs), hafnium (Hf) and zinc (Zn).

In accordance with an embodiment of the present invention, the shell-forming material may include at least one of metal acetate, metal bromide, metal carbonate, metal chloride, metal fluoride, metal hydroxide, metal iodide, metal nitrate, metal oxide, metal phosphate, metal silicate, metal sulfate, and metal sulfide.

In accordance with another aspect of the present invention, there is provided a nickel nanopowder produced according to the method of producing a nickel nanopowder and composed of nickel.

In accordance with an embodiment of the present invention, the nickel nanopowder may have an average particle size of 30 nm to 200 nm; and a coagulation rate of 0.5% to 50%.

In accordance with an embodiment of the present invention, the nickel nanopowder may include a natural oxide layer formed on a surface thereof.

In accordance with an embodiment of the present invention, the nickel nanopowder may include 50% by weight to 100% by weight of nickel.

In accordance with an embodiment of the present invention, the nickel nanopowder may have a core-shell structure and may include nickel core particles; and a shell layer formed to surround surfaces of the nickel core particles and composed of a water-soluble metal salt.

In accordance with an embodiment of the present invention, a method of producing the metal nanopowder may include providing a metal salt and a shell-forming material; nucleating and growing metal core particles from the metal salt; forming a shell layer on the surface of the metal core particles using the shell-forming material; and removing the shell layer to form the metal nanopowder.

Effect of Invention

According to the technical idea of the present invention, coagulation between particles can be provided by forming a shell layer composed of water-soluble metal on the surface of nickel core particles in a high-temperature environment, and then easily removing the shell layer by a wet method at a low temperature, thereby being capable of providing a nickel nanopowder having a small average particle size and a low high coagulation rate.

The above effects of the present invention are described as examples, and the scope of the present invention is not limited by the effects.

BRIEF DESCRIPTION OF DRAWINGS

FIG. 4 is a table showing the solubility of candidate materials of a shell-forming material used in a method of producing a nickel nanopowder according to the technical idea of the present invention.

BEST MODE

Figure 1:
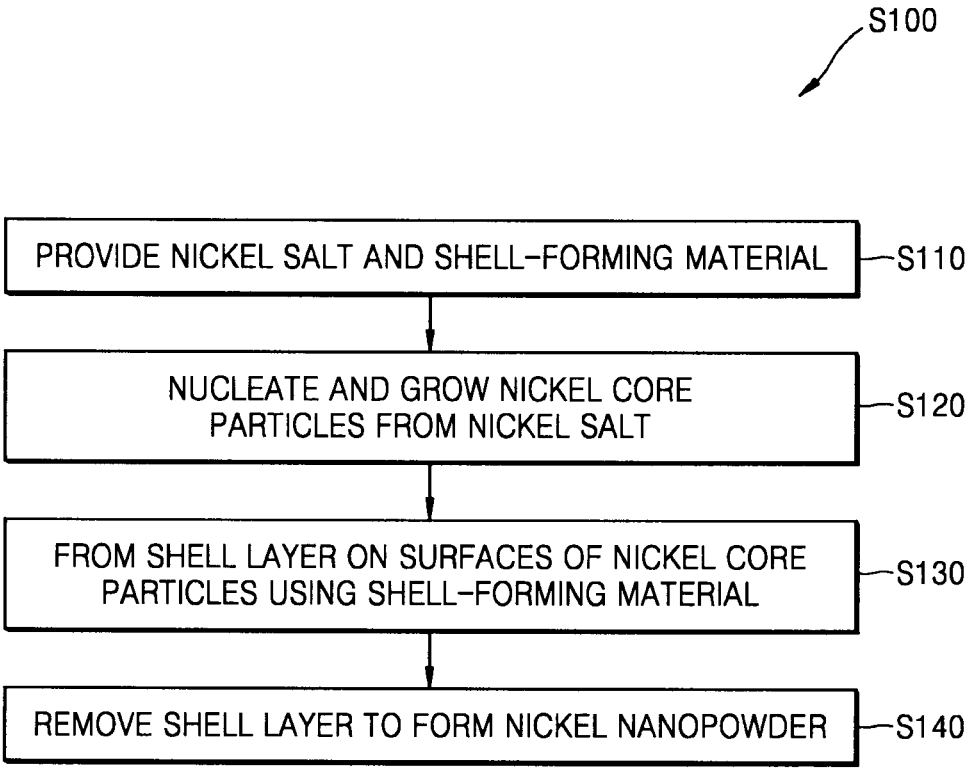
FIG. 1 is a flowchart illustrating a method of producing a nickel nanopowder according to the technical idea of the present invention.

Hereinafter, preferred embodiments of the present invention will be described in detail with reference to the accompanying drawings. Embodiments of the present invention are provided to more completely explain the technical idea of the present invention to those skilled in the art, and the following embodiments may be modified in many different forms, but the scope of the technical idea of the present invention is not limited to the following embodiments. Rather, the embodiments are provided to make the invention thorough and complete and to fully convey the technical idea of the invention to those skilled in the art. Like reference numerals in the specification denote like elements. Further, various elements and regions in the drawings are schematically drawn. Therefore, the technical idea of the present invention is not limited by the relative size or spacing drawn in the accompanying drawings.

The technical idea of the present invention relates to a method of producing a metal nanopowder using a vapor phase deposition. According to the technical idea of the present invention, a nickel nanopowder used in a Multi-Layer Ceramic Capacitor (MLCC) may be formed as an exemplary metal nanopowder.

The MLCC is undergoing microminiaturization and high stratification, and accordingly, ultra-thin stratification of the nickel electrode layer is required. According to the ultra-thin stratification of the nickel electrode layer, a problem of disconnection due to oversintering or powder coagulation occurs when using a conventional nickel powder having a size of 500 nm or more. Specifically, for microminiaturization and high stratification of MLCC, a nickel powder having a particle diameter of 100 nm or less and the gas phase reactor design technology are required. To improve the sintering uniformity of MLCC, the nickel powder should have a uniform particle size distribution, and the powder classification technology needs to be improved. To cope with an increase in the sintering temperature of MLCC, a treatment to remove an oxide film formed on the surface of the nickel powder is required. To prevent cracking during sintering of MLCC, a nickel powder should have low coagulation characteristics, and for this purpose, surface chemical treatment of the nickel powder is required.

A nickel electrode layer of MLCC is manufactured by printing a fine nickel powder paste on a ceramic layer. The nickel powder is prepared by a dry method such as an evaporation condensation method, a thermal decomposition method, a gas phase reaction method, an electric explosion method or a wet method such as a liquid phase reduction method, a hydrothermal synthesis method, or a chemical precipitation method. The dry method allows production of a high-purity, high-quality nanopowder, but has low productivity and requires high equipment investment costs. The wet method is advantageous in terms of low production costs and mass production, but has disadvantages in that it is difficult to control impurities such as organic matters and to control a particle size. Therefore, the dry method is suitable for use in fields requiring high purity and high crystallinity, but, in the case of the dry method, surfactants cannot be used, coagulation between particles strongly occurs because it is a high-temperature process, and the yield is decreased because a classification process that classifies particles according to size should be used. Accordingly, coagulation between particles can be prevented, so a high yield can be achieved when the classification process is not performed.

In the following description, the case of producing a metal nanopowder using chemical vapor synthesis (CVS) is described, but this is exemplary and the technical idea of the present invention is not limited thereto. The technical idea of the present invention also includes the case of using physical vapor synthesis (PVS) using DC plasma, RF plasma, etc.

FIG. 1 is a flowchart illustrating a method (S100) of producing a nickel nanopowder according to the technical idea of the present invention.

Referring to FIG. 1, the method (S100) of producing a nickel nanopowder includes a step (S110) of providing a nickel salt and a shell-forming material; a step (S120) of nucleating and growing nickel core particles from the nickel salt; a step (S130) of forming a shell layer on a surface of the nickel core particles using the shell-forming material; and a step (S140) of removing the shell layer to form a nickel nanopowder.

The shell layer may induce non-sintering-type coagulation of the nickel core particles. In addition, the non-sintering-type coagulated nickel core particles may be individualized by removing the shell layer to form the nickel nanopowder.

The step (S110) of providing a nickel salt and a shell-forming material may be provided by vaporizing the nickel salt and a shell-forming material. The step (S110) may be performed at a temperature at which the nickel salt changes from a solid phase to a gas phase. The nickel salt and the shell-forming material may be provided, for example, by vaporizing at a temperature of 300° C. to 1200° C.

The nickel salt and the shell-forming material may be provided, for example, in a weight ratio of 3:1 to 65:1. The nickel salt and the shell-forming material may be provided together through mixing or may be individually provided.

In addition, the shell-forming material may be provided in a range of 0.4 mmol/L to 2.5 mmol/L in a molar ratio per the volume of an injection gas.

The vaporized nickel salt and the vaporized shell-forming material may be transported within a reaction chamber by a carrier gas. The carrier gas may include argon gas or nitrogen gas.

The step (S120) of nucleating and growing the nickel core particles may form the nickel core particles in a solid phase by reducing the nickel salt using a reducing gas, e.g., a hydrogen-containing gas. The step (S120) of nucleating and growing the nickel core particles may be performed at a temperature of, for example, 800° C. to 1200° C.

For example, when the nickel salt is nickel chloride ($NiCl_2$), the nickel core particles may be formed by the following reactions:

Nickel salt vaporization reaction: $NiCl_2(s) \Rightarrow NiCl_2(g)$

Nickel core particle generation reaction: $NiCl_2(g) + H_2(g) \Rightarrow Ni(s) + 2HCl(g)$ The reducing gas may include a gas that causes a reduction reaction. The reducing gas may include, for example, hydrogen gas, carbon monoxide gas, magnesium vapor gas, calcium vapor gas, and the like.

The nickel core particles may include, for example, 50% by weight or more of nickel, and may include nickel, for example, in a range of 50% by weight to 100% by weight. The balance may consist of unavoidable impurities such as oxides and chlorides.

In the step (S130) of forming the shell layer, the vaporized shell-forming material is deposited and grown on surfaces of the nickel core particles to form the shell layer. The shell-forming material may form the shell layer as a solid phase through a liquid phase from a gaseous state, or may be directly changed from a gaseous state to a solid phase to form the shell layer.

The step (S130) of forming the shell layer may be performed in a region where a temperature decreases according to a direction in which the nickel core particles are transported. The step (S130) may be performed below the temperature at which the shell-forming material starts to precipitate and grow or above a temperature at which the nickel nanopowder can be sintered or coagulated. The step (S130) may be performed at a temperature of, for example, 300° C. to 1200° C.

In the step (S130) of forming the shell layer, the free energy of formation of the shell-forming material may be smaller than that of the nickel salt. In addition, the free energy of formation of the shell-forming material may be smaller than the free energy of formation of chlorine gas (HCl) formed by the reaction of the nickel salt and the reducing gas. In addition, the shell-forming material may have an equilibrium vapor pressure of, for example, 0.9 kPa to 54 kPa.

The step (S110) to the step (S130) may be performed using a heat treatment furnace, and may be sequentially performed while the nickel salt, the shell-forming material, and the nickel core particles are transferred in one heat treatment furnace.

The step (S140) of forming the nickel nanopowder may be achieved by selectively removing the shell layer through a wet post-treatment without removing the nickel nanopowder. The wet post-treatment may be performed using water, or may be performed using an acidic or basic solution. For this post-treatment, the nickel nanopowder where the shell layer is formed may be discharged from the used heat treatment furnace, and then charged into a wet processor.

The nickel salt may include, for example, at least one of nickel acetate, nickel bromide, nickel carbonate, nickel chloride, nickel fluoride, nickel hydroxide, nickel iodide, nickel nitrate, nickel oxide, nickel phosphate, nickel silicate, nickel sulfate, and nickel sulfide.

The shell-forming material may include a water-soluble metal salt. The shell-forming material may include at least one of, for example, aluminum (Al), barium (Ba), calcium (Ca), chromium (Cr), cobalt (Co), copper (Cu), iron (Fe), lead (Pb), lithium (Li), magnesium (Mg), manganese (Mn), mercury (Hg), nickel (Ni), potassium (K), rubidium (Rb), silver (Ag), sodium (Na), strontium (Sr), tin (Sn), lanthanum (La), silicon (Si), gallium (Ga), scandium (Sc), titanium (Ti), vanadium (V), zirconium (Zr), yttrium (Y), cadmium (Cd), actinium (Ac), cesium (Cs), hafnium (Hf) and zinc (Zn).

The shell-forming material may include at least one of, for example, metal acetate, metal bromide, metal carbonate, metal chloride, metal fluoride, metal hydroxide, metal iodide, metal nitrate, metal oxide, metal phosphate, metal silicate, metal sulfate, and metal sulfide. Here, the metal included in the shell-forming material may include at least one of, for example, aluminum (Al), barium (Ba), calcium (Ca), chromium (Cr), cobalt (Co), copper (Cu), iron (Fe), lead (Pb), lithium (Li), magnesium (Mg), manganese (Mn), mercury (Hg), nickel (Ni), potassium (K), rubidium (Rb), silver (Ag), sodium (Na), strontium (Sr), tin (Sn), lanthanum (La), silicon (Si), gallium (Ga), scandium (Sc), titanium (Ti), vanadium (V), zirconium (Zr), yttrium (Y), cadmium (Cd), actinium (Ac), cesium (Cs), hafnium (Hf) and zinc (Zn).

A nickel nanopowder may be formed by the method (S100) of producing a nickel nanopowder described above. The nickel nanopowder may include a natural oxide layer formed on a surface thereof. A reducing atmosphere may be maintained during the entire reaction period in the method (S100) of producing a nickel nanopowder described above and, in this case, a natural oxide layer may not be formed on the surface of the nickel nanopowder. When the reaction is completed and the nickel nanopowder is transferred from a reducing atmosphere to an atmospheric atmosphere, the natural oxide layer may be formed on the surface of the nickel nanopowder.

The nickel nanopowder may include, for example, 50% by weight or more of nickel and may include nickel, for example, in a range of 50% by weight to 100% by weight. The balance may consist of unavoidable impurities such as oxides and chlorides.

The nickel nanopowder may have an average particle size of, for example, 30 nm to 200 nm and a coagulation rate of, for example, 0.5% to 50%.

The nickel nanopowder is a nickel nanopowder having a core-shell structure and may include nickel core particles; and a shell layer formed of a water-soluble metal salt surrounding the surfaces of the nickel core particles. The shell layer of the nickel nanopowder may be removed by cleaning.

The method of producing a nickel nanopowder according to the technical idea of the present invention may be extended to various methods of producing a metal nanopowder.

Figure 2:
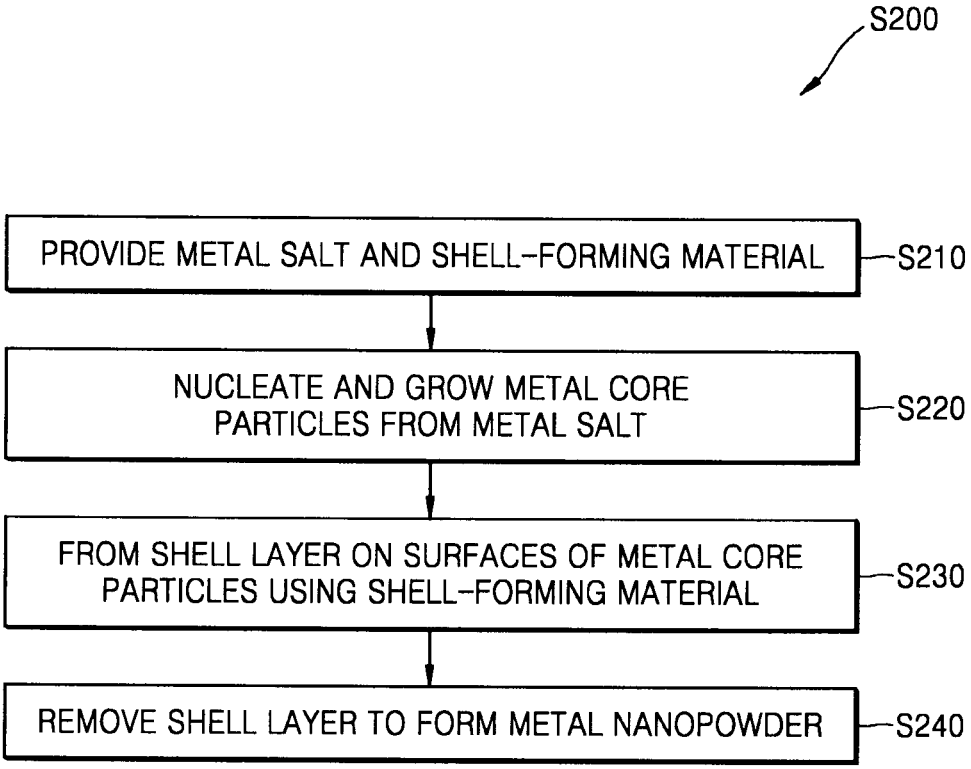
FIG. 2 is a flowchart illustrating a method of producing a metal nanopowder according to the technical idea of the present invention.

FIG. 2 is a flowchart illustrating a method (S200) of producing a metal nanopowder according to the technical idea of the present invention.

Referring to FIG. 2, the method (S200) of producing a metal nanopowder includes a step (S210) of providing a metal salt and a shell-forming material; a step (S220) of nucleating and growing metal core particles from the metal salt; a step (S230) of forming a shell layer on surfaces of the metal core particles using the shell-forming material; and a step (S240) of removing the shell layer to form the metal nanopowder.

Figure 3:
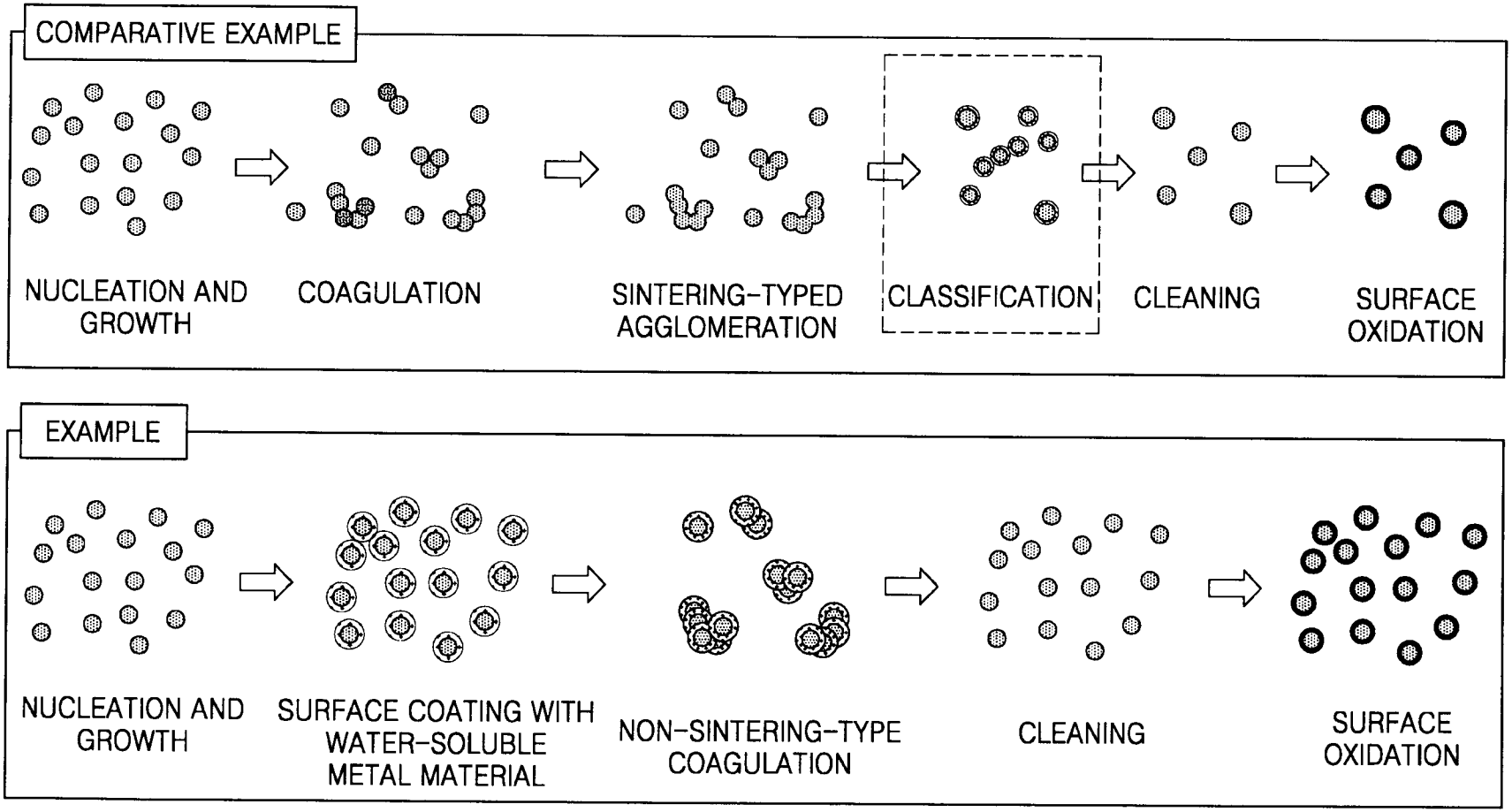
FIG. 3 is a schematic diagram illustrating the principle of a method of producing a nickel nanopowder according to the technical idea of the present invention.

FIG. 3 is a schematic diagram illustrating the principle of a method of producing a nickel nanopowder according to the technical idea of the present invention.

Referring to FIG. 3, in the comparative example, nickel particles are formed through nucleating and growing, and then the nickel particles coagulate with each other and are agglomerated in a sintering-type in a high-temperature environment. The sintering-type agglomeration means that particles are relatively strongly bonded by sintering. By such sintering-type agglomeration, the sizes of formed nickel particles are different depending on the case where a large number of nickel particles are agglomerated and the case where a small number of nickel particles are agglomerated. Accordingly, nickel particles should be separated into a target size range through a classification process. Subsequently, a nickel nanopowder is formed through a cleaning process and surface oxidation. Since nickel particles agglomerated in a large size are removed by a classification process, there is a problem in that the yield of a produced nickel nanopowder is decreased.

On the other hand, in an embodiment of the method of producing a nickel nanopowder according to the technical idea of the present invention, nickel core particles are formed through nucleating and growing, and then the surface of the nickel core particles is coated with a water-soluble metal material, i.e., a shell-forming material. That is, nickel core particles on the surface of which a shell layer is formed may be formed. Since the water-soluble metal material coated on the surface of the nickel core particles can be prevented from being sintered, the nickel core particles are coagulated in a non-sintering type. The non-sintering-type coagulation means that nickel particles are relatively weakly coupled by electrostatic coupling. Next, when the nickel particles are cleaned, the water-soluble metal material constituting the shell coated on the surface of the nickel particles is removed, and the coagulated nickel particles are separated from each other. Next, a nickel nanopowder is formed through surface oxidation. Since the classification process is not performed in this embodiment, removal of nickel particles may be minimized, so the yield of the nickel particles increases.

The water-soluble metal material as the shell-forming material may be selected according to the following criteria.

1) Ease of removal: The shell-forming material should be easily removable from a recovered nickel powder. For example, the shell-forming material should be easily removable with water, an acidic solution or a basic solution. In addition, it is desirable not to form insoluble compounds.
2) Vaporization vapor pressure: The shell-forming material should have sufficient vapor pressure for easy vaporization over a range of temperatures.
3) Reactivity: The shell-forming material is preferably non-reactive with gases used in a manufacturing process or gases produced by a reaction, and if a reaction occurs, a reaction product should satisfy this selection criterion. In addition, it is preferable that thermal decomposition does not occur at a manufacturing process temperature, and if thermal decomposition occurs, a product should satisfy this selection criterion.

4) Solidification vapor pressure: The shell-forming material should have sufficient vapor pressure for easy solidification in a certain temperature range. That is, precipitation (shell formation) should occur in an appropriate amount at an appropriate temperature by inputting an appropriate amount of the shell-forming material. If a too large amount of a shell-forming material is required for the formation of the shell, there is a risk that a lot of energy is consumed for vaporization or a reaction rate is reduced.

Hereinafter, an experimental example of selecting a shell-forming material according to the selection criteria is described as an example.

FIG. 4 is a table showing the solubility of candidate materials of a shell-forming material used in a method of producing a nickel nanopowder according to the technical idea of the present invention.

FIG. 4 shows the solubility in water according to cations and anions of the compound capable of constituting the shell-forming material. In the table, "S" represents the case of well soluble, "ss" represents the case of less soluble than "S", "I" represents the case of insoluble, and "DR" represents the case that decomposition occurs.

According to the solubility of FIG. 4, an acetate compound, a bromide compound, and a chloride compound may be selected as candidate materials for the shell-forming material, on the premise that water will be used when removing the shell after forming the shell.

Next, since the shell-forming material requires a material with high vaporization vapor pressure, a chloride compound may be selected as a candidate material for the shell-forming material.

Next, since the shell-forming material requires a material that is not reactive with gases used or produced during the manufacturing process, and the Ellingham diagram was used.

Figure 5:
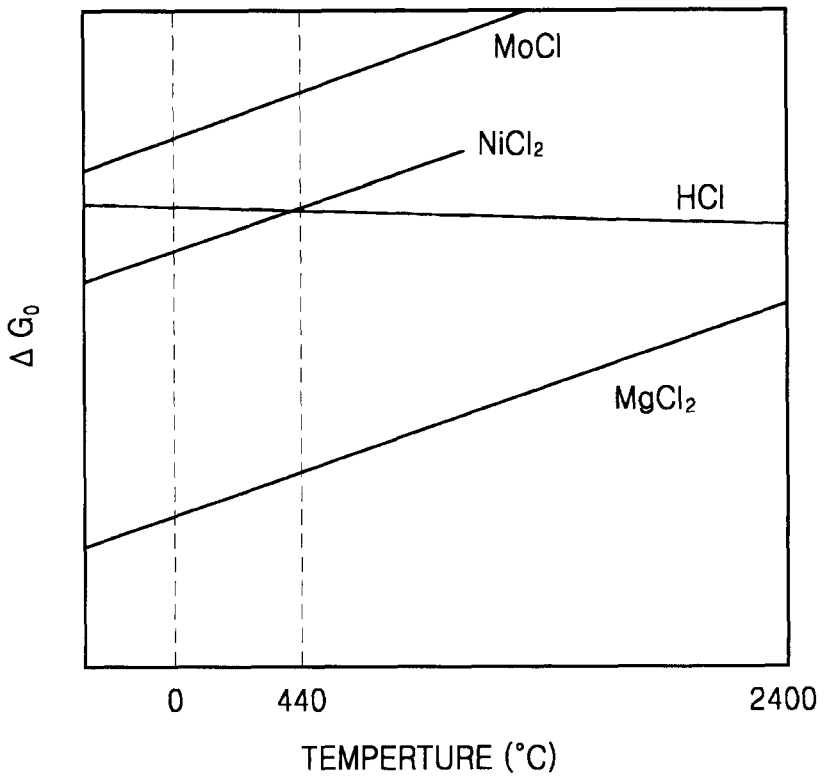
FIG. 5 illustrates the Ellingham diagram a candidate material of a shell-forming material used in a method of producing a nickel nanopowder according to the technical idea of the present invention.

FIG. 5 illustrates the Ellingham diagram a candidate material of a shell-forming material used in a method of producing a nickel nanopowder according to the technical idea of the present invention.

Referring to FIG. 5, since MoCl has a high free energy of formation in the entire temperature range based on the free energy of formation of a reaction product HCl, MoCl has low stability and may not be selected as a candidate material for the shell-forming material. On the other hand, since $MgCl_2$ has low formation free energy in the entire range of process temperature and high stability, it may be selected as a candidate material for the shell-forming material. As such, $MgCl_2$, $LaCl_3$, LiCl, $SrCl_3$, $SiCl_4$, $GaCl_3$, $ScCl_3$, NaCl, KCl, $UCl_5$, $TiCl_4$, $ZnCl_2$, $VCl_2$, $ZrCl_4$, $UCl_3$, $YCl_3$, RbCl, $CdCl_2$, $AlCl_3$, $AcCl_3$, $CaCl_2$, $BaCl_2$, CsCl, $HfCl_4$, etc. may be selected as a candidate material for the shell-forming material based on the free energy of formation provided in the Ellingham diagram.

Next, the candidate material of the shell-forming material needs to have a vapor pressure sufficient to form a shell in a given temperature range in terms of process conditions. Accordingly, based on a material having a boiling point of, e.g., 300° C. or more or 700° C. or more, $MgCl_2$, $LaCl_3$, LiCl, NaCl, KCl, $ZnCl_2$, $YCl_3$, RbCl, $CdCl_2$, $CaCl_2$), $BaCl_2$, CsCl, etc. may be selected as a candidate material of the shell-forming material.

Next, to satisfy the selection criterion of vaporization vapor pressure, it is necessary to examine an equilibrium vapor pressure for each temperature. Accordingly, NaCl, KCl, $ZnCl_2$, LiCl, $CaCl_2$), $MgCl_2$, CsCl, $BaCl_2$, etc. may be selected as a candidate material of the shell-forming material using the Clausius-Clapeyron relation.

Figure 6:
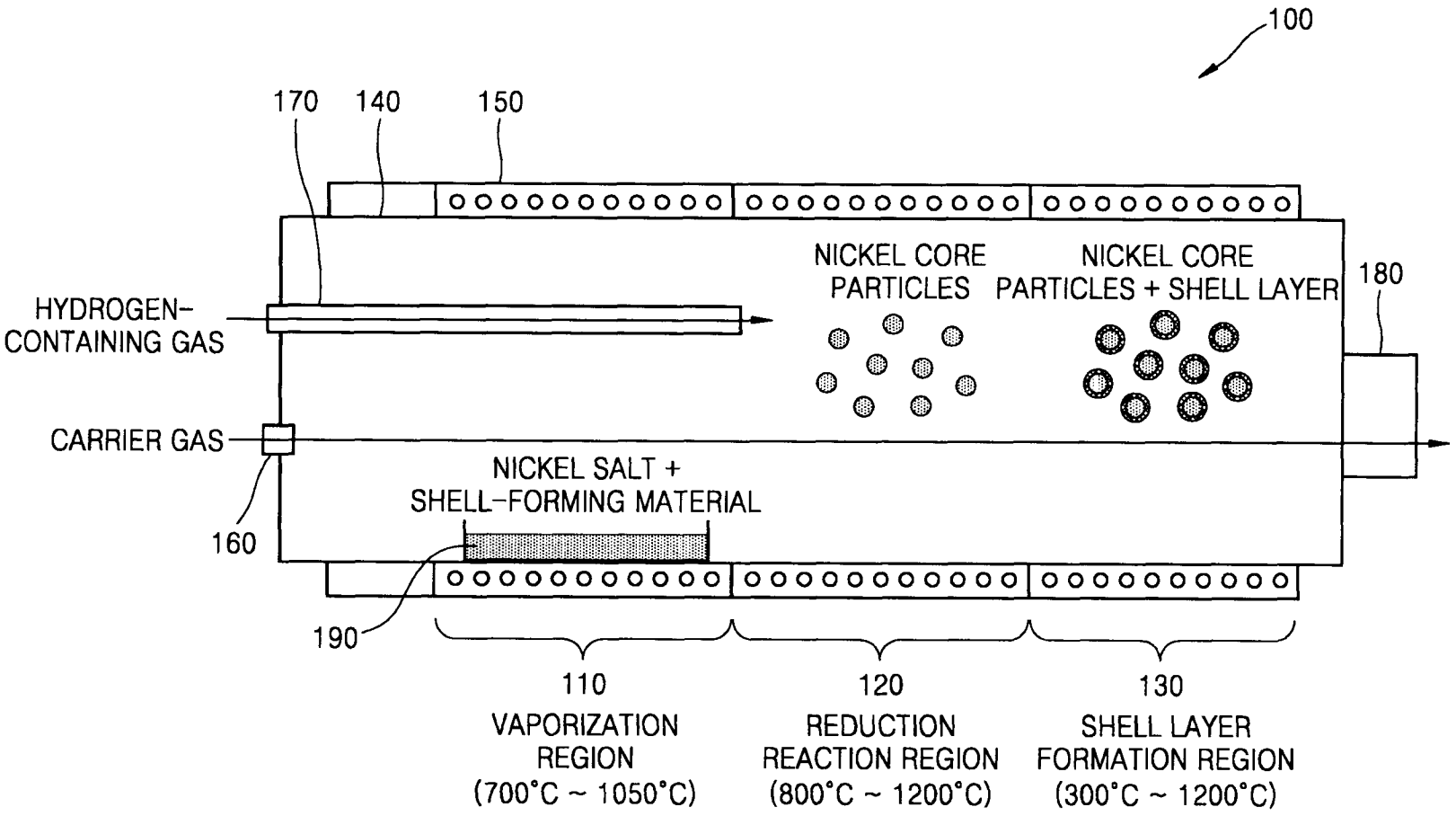
FIG. 6 illustrates a schematic diagram of an apparatus for producing a metal nanopowder used to perform a method of producing a nickel nanopowder according to the technical idea of the present invention.

FIG. 6 illustrates a schematic diagram of an apparatus 100 for producing a metal nanopowder used to perform a method of producing a nickel nanopowder according to the technical idea of the present invention.

Referring to FIG. 6, the apparatus 100 for producing a metal nanopowder may be divided into a vaporization region 110, a reduction reaction region 120, and a shell layer formation region 130.

In the vaporization region 110, a nickel salt and a shell-forming material may be vaporized, and the temperature thereof may be, for example, 300° C. to 1200° C.

In the reduction reaction region 120, the nickel salt may react with a reducing gas to form nickel core particles, and the temperature thereof may be, for example, 800° C. to 1200° C.

In the shell layer formation region 130, a shell may be formed on the surface of the nickel core particles, and the temperature thereof may be, for example, 300° C. to 1200° C.

The apparatus 100 for producing a metal nanopowder includes a reactor body 140, a heater part 150 located on an outer surface of the reactor body 140 and configured to provide heat to the reactor body 140, a carrier gas supply part 160 located at one end of the reactor body 140 and configured to supply a carrier gas, a reducing gas supply part 170 located at one end of the reactor body 140 and configured to supply reducing gas, and a filter part 180 located at another end of the reactor body 140 and configured to obtain shell-formed nickel core particles by filtering discharged gas.

An operation method of the apparatus 100 for producing a metal nanopowder is as follows.

A nickel salt and a shell-forming material 190 are charged into the vaporization region 110 inside the reactor body 140 of the apparatus 100 for producing a metal nanopowder. This charging may be accomplished by containing the nickel salt and the shell-forming material 190 in a container or by using a device such as an injector. In addition, the nickel salt and the shell-forming material 190 may be mixed and charged together or separately.

When the nickel salt and the shell-forming material 190 are heated and vaporized in the vaporization region 110 by the heater part 150, the nickel salt and the shell-forming material are transferred to the reduction reaction region 120 by a carrier gas supplied through the carrier gas supply part 160.

In the reduction reaction region 120, heat may be supplied to the vaporized nickel salt and the shell-forming material by the heater part 150 to maintain or increase the temperature. The nickel salt is reduced by reducing gas supplied through the reducing gas supply part 170 to form nickel core particles. Next, the nickel core particles and the shell-forming material are transported by the carrier gas to the shell layer formation region 130.

Heat may be supplied to the nickel core particles and the shell-forming material in the shell layer formation region 130 by the heater part 150 such that the temperature is maintained or gradually decreased. However, this is exemplary and the heater part 150 may be omitted. Atmospheric temperature is reduced in the shell layer formation region 130 and, accordingly, a shell-forming material is attached to the surface of the nickel core particles to form a shell layer.

The nickel core particles on which the shell layer is formed are transferred to the filter part 180 by the carrier gas and filtered in the filter part 180.

EXPERIMENTAL EXAMPLES

Hereinafter, a preferred experimental example is presented to help the understanding of the present invention. However, the experimental example below is only for helping to understand the present invention, and the present invention is not limited to the experimental example below.

In the following experimental examples, $NiCl_2$ hexahydrate was used as a nickel salt, and KCl anhydrate or NaCl anhydrate was used as a shell-forming material. The nickel salt and the shell-forming material were mixed in various weight ratios and dissolved in distilled water. Next, A solid mixture powder of a nickel salt and a shell-forming material was formed using spray drying, and the mixture powder was provided in the step of providing a nickel salt and a shell-forming material of the production method of the present invention. Next, a nickel nanopowder was formed using the above-described method of producing a nickel nanopowder.

In the case of the comparative example, a nickel salt was vaporized using only $NiCl_2$ and reacted with hydrogen gas to be vapor deposited, thereby forming a nickel nanopowder. That is, a shell-forming material was not used in the comparative example.

Table 1 shows various mixing weight ratios of the nickel salt and the shell-forming material of the examples of the present invention.

TABLE 1

| | Nickel salt | Shell-forming material | |
|---|---|---|---|
| Classification | $NiCl_2$ hexahydrate | KCl anhydrate | NaCl anhydrate |
| Example 1 | 21.58 | 1 | — |
| Example 2 | 8.45 | 1 | — |
| Example 3 | 3.33 | 1 | — |
| Example 4 | 61.22 | — | 1 |
| Example 5 | 24.39 | — | 1 |
| Example 6 | 10.35 | — | 1 |

Figure 7:
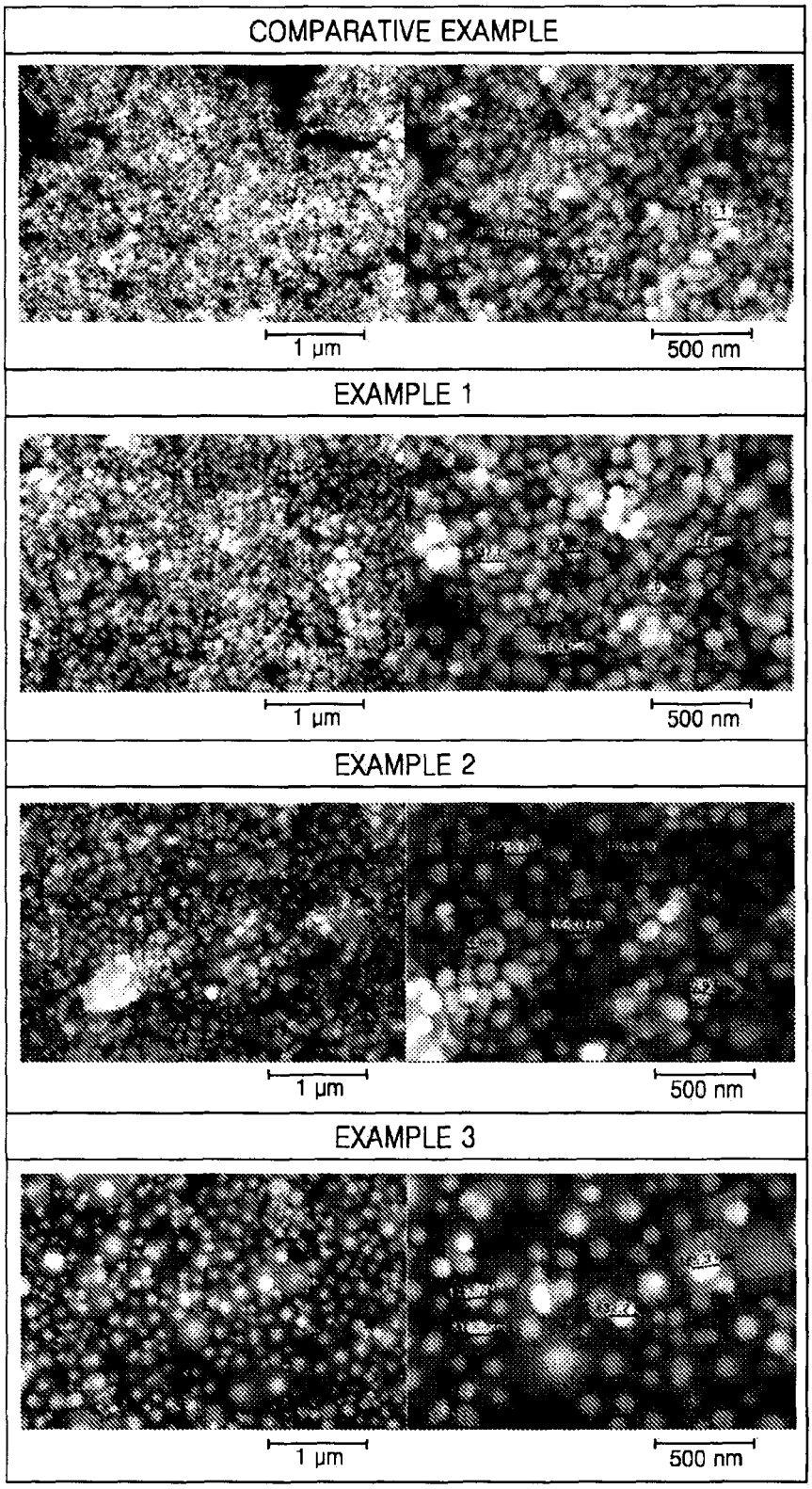
FIGS. 7 and 8 are scanning electron microscopic images illustrating nickel nanopowder particles formed using the method of producing a nickel nanopowder according to the technical idea of the present invention.
Figure 8:
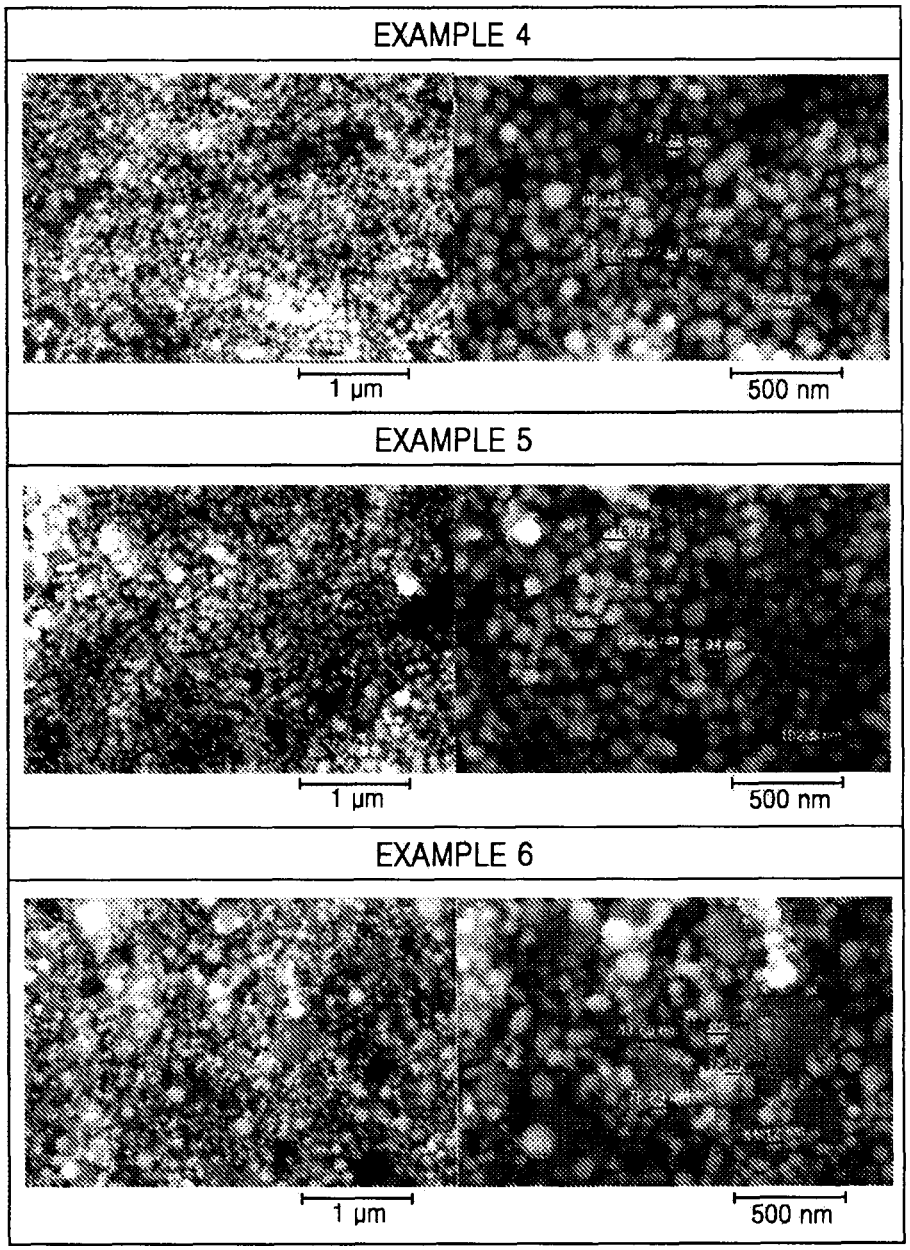

FIGS. 7 and 8 are scanning electron microscopic images illustrating nickel nanopowder particles formed using the method of producing a nickel nanopowder according to the technical idea of the present invention.

Referring to FIGS. 7 and 8, a lot of sintering-type agglomerated nickel nanopowder particles were observed in the comparative example. This is analyzed to be because the solidified nickel particles are agglomerated and sintered with each other at a high temperature due to the absence of the shell-forming material, and it is difficult to separate the agglomerated nickel particles in a subsequent process.

When analyzing the case where the KCl anhydrate was used as the shell-forming material, relatively few of the sintering-type agglomerated nickel nanopowders were observed in Examples 1 and 2, and almost none were observed in Example 3.

When analyzing the case of using the NaCl anhydrate as the shell-forming material, relatively few of the sintering-type agglomerated nickel nanopowders were observed in Examples 4, 5, and 6.

Figure 9:
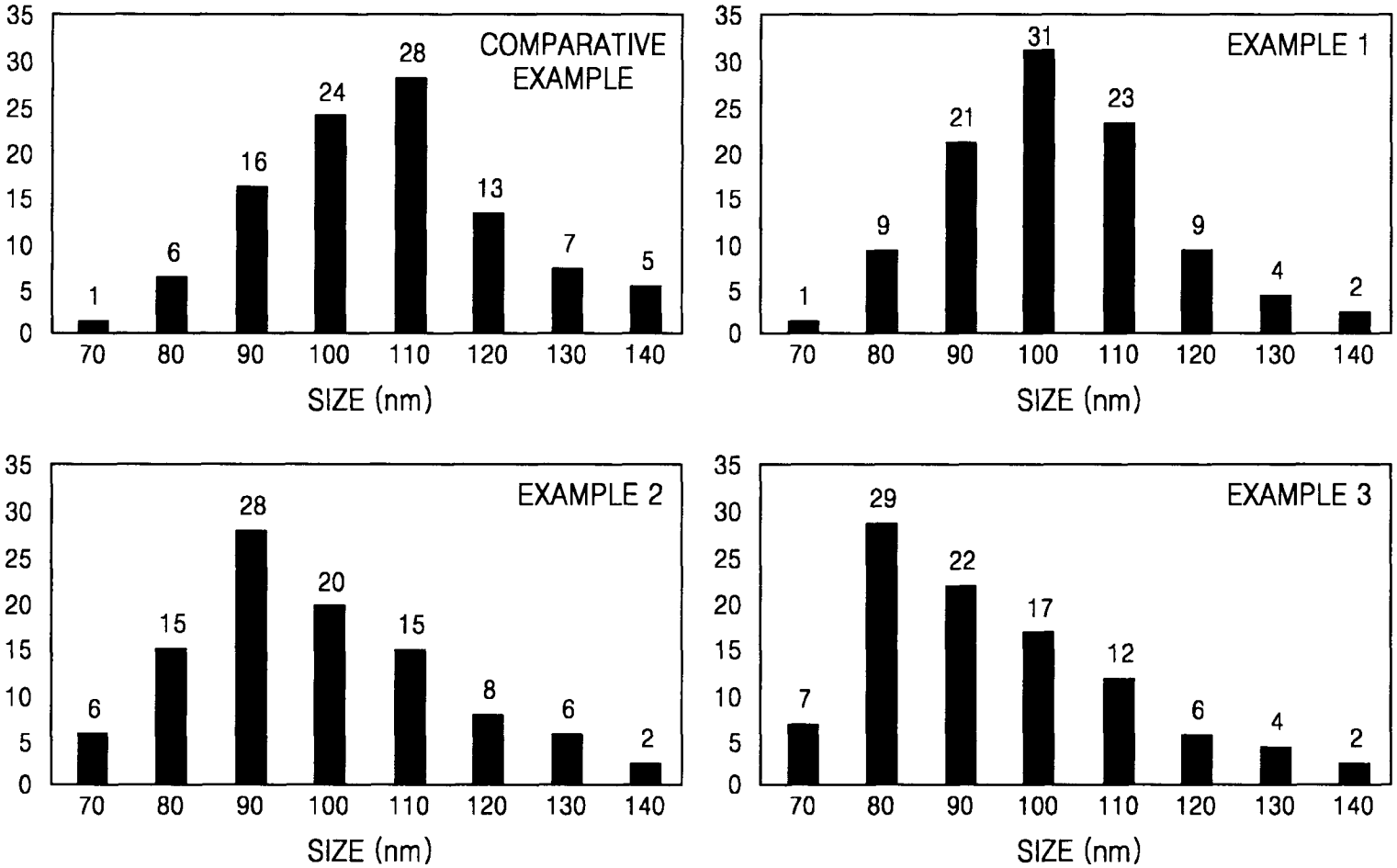
FIGS. 9 and 10 illustrate the size distribution of nickel nanopowder particles formed using the method of producing a nickel nanopowder according to the technical idea of the present invention.
Figure 10:
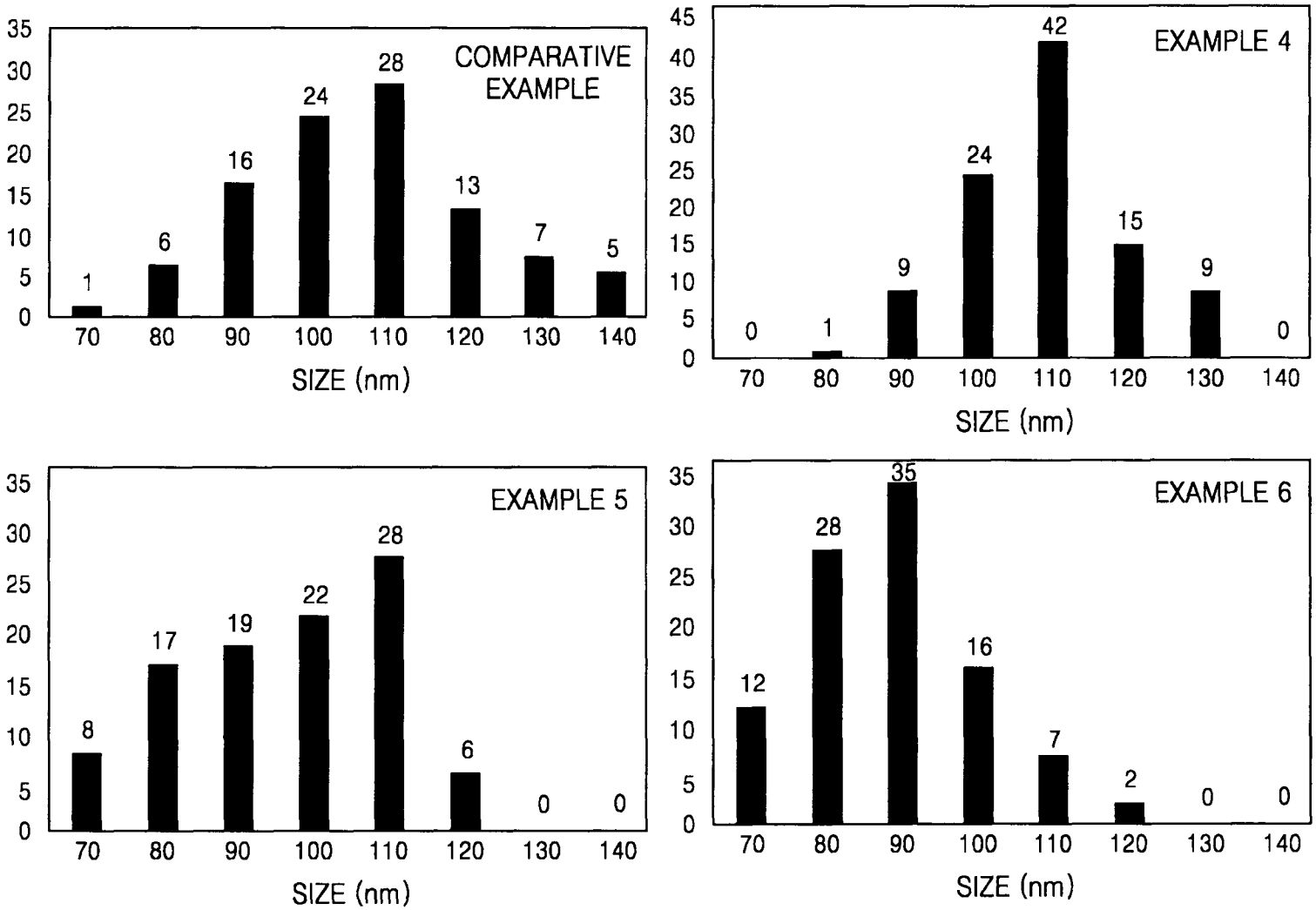

FIGS. 9 and 10 illustrate the size distribution of nickel nanopowder particles formed using the method of producing a nickel nanopowder according to the technical idea of the present invention.

FIGS. 9 and 10 show the size distribution of the nickel nanopowder of each of the comparative example and Examples 1 to 6. Based on the graphs, the average particle sizes, particle size distributions, and coagulation rates of the produced nickel nanopowders are shown in Table 2. In Table 2 below, a median diameter value was used for the average particle size, and a geometric standard deviation was used for the particle size distribution.

TABLE 2

| Classification | Average particle size (nm) | Particle size distribution (nm) | Coagulation rate (%) |
|---|---|---|---|
| Comparative example | 99.88 | 1.17 | 51.00 |
| Example 1 | 95.94 | 1.15 | 37.75 |
| Example 2 | 91.66 | 1.19 | 23.00 |
| Example 3 | 88.48 | 1.20 | 8.50 |
| Example 4 | 95.94 | 1.15 | 55.50 |
| Example 5 | 91.66 | 1.19 | 55.00 |
| Example 6 | 82.70 | 1.15 | 37.75 |

Referring to Table 2, compared to the comparative example, the examples showed a decrease in average particle size and a decrease in coagulation rate. In Examples 1 to 3 using KCl as the shell-forming material, it can be confirmed that the average particle size is reduced and the coagulation rate is decreased with increasing content of the $NiCl_2$ hexahydrate. In Examples 4 to 6 using NaCl as the shell-forming material, the average particle size was reduced and the coagulation rate was decreased with increasing content of the $NiCl_2$ hexahydrate. However, Examples 4 and 5 showed a coagulation rate slightly higher than that of the comparative example.

Figure 11:
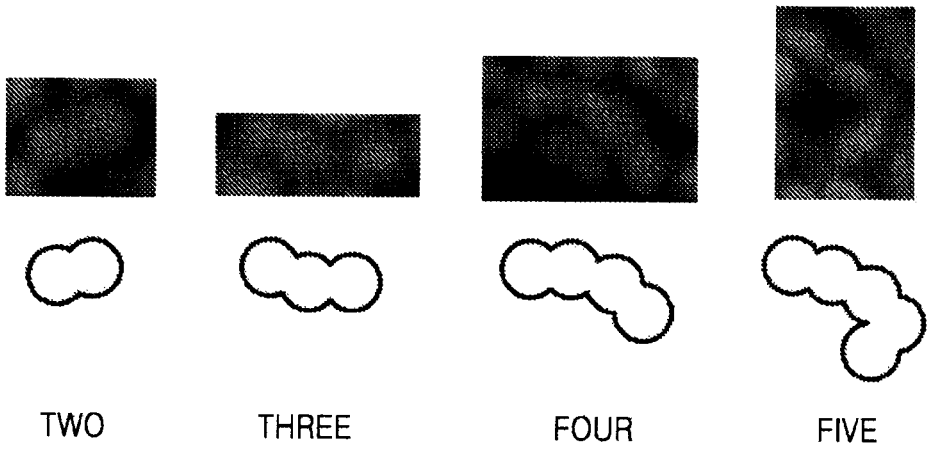
FIG. 11 illustrates the coagulated state of a nickel nanopowder formed using a method of producing a nickel nanopowder according to the technical idea of the present invention.

FIG. 11 illustrates the coagulated state of a nickel nanopowder formed using a method of producing a nickel nanopowder according to the technical idea of the present invention.

FIG. 11 shows states in which 2, 3, 4, and 5 nickel particles are coagulated as shown in the scanning electron microscopic images of the nickel nanopowders of FIGS. 7 and 8. The number of coagulated particles was calculated from the images and summarized in Table 3.

TABLE 3

| Classification | Two | Three | Four | Five |
|---|---|---|---|---|
| Comparative example | 49 | 17 | 10 | 3 |
| Example 1 | 38 | 13 | 9 | 0 |
| Example 2 | 24 | 8 | 5 | 0 |
| Example 3 | 9 | 4 | 1 | 0 |
| Example 4 | 42 | 30 | 7 | 4 |
| Example 5 | 37 | 21 | 12 | 7 |
| Example 6 | 24 | 14 | 9 | 5 |

Referring to Table 3, compared to the comparative example, the examples showed a general decrease in the number of coagulated particles. In particular, in Example 3 using KCl as the shell-forming material, the number of coagulated particles was significantly reduced.

Analyzing the results, as the weight ratio of the nickel salt ($NiCl_2$ hexahydrate) to the shell-forming particles (KCl or NaCl) increases, the sintering-type agglomerated nickel particles decrease, and a nickel nanopowder individualized after being coagulated in a non-sintering type may be more easily formed. In addition, it can be confirmed that KCl is more effective in preventing coagulation of nickel particles, compared to NaCl. This is analyzed to be because the precipitation amount of NaCl is smaller than that of KCl at the same temperature.

Figure 12:
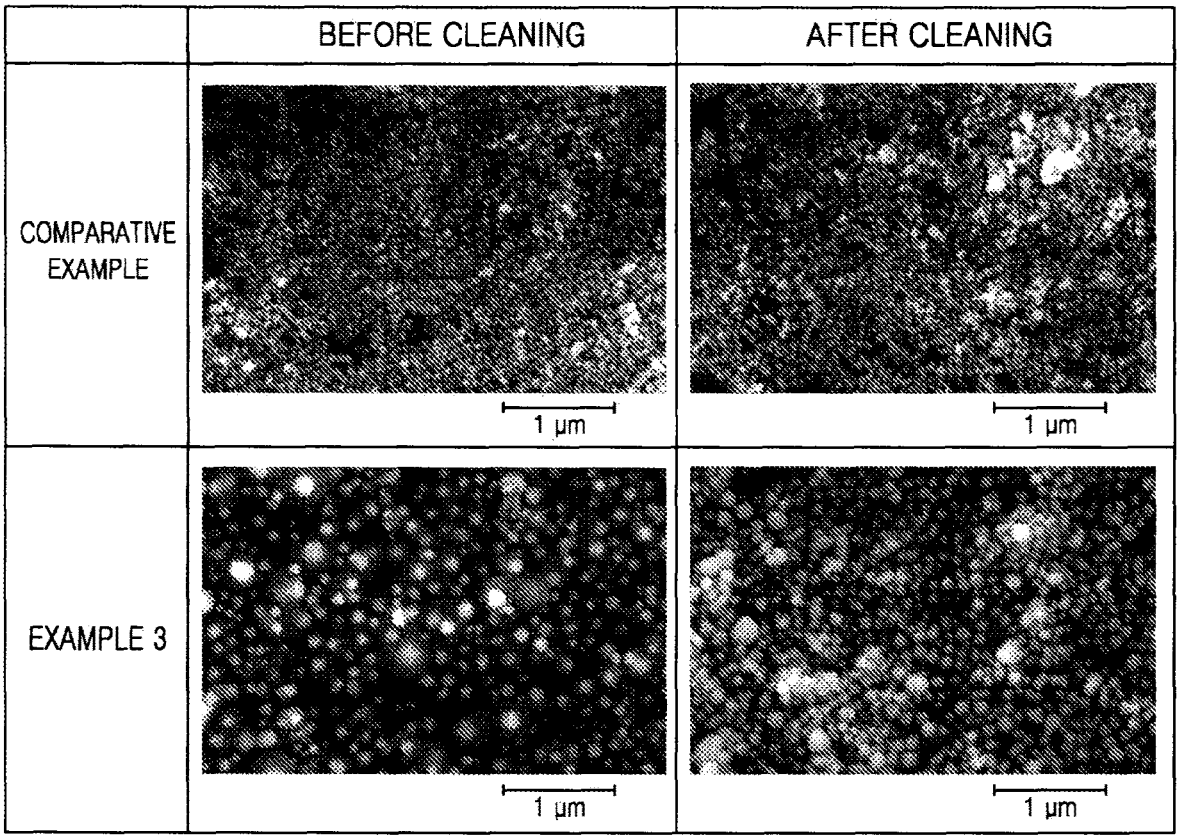
FIG. 12 are scanning electron microscopic images illustrating the surface state before and after washing with distilled water of a nickel nanopowder formed using a method of producing a nickel nanopowder according to the technical idea of the present invention.

FIG. 12 are scanning electron microscopic images illustrating the surface state before and after washing with distilled water of a nickel nanopowder formed using a method of producing a nickel nanopowder according to the technical idea of the present invention.

Referring to FIG. 12, in the case of the comparative example, there was little change in the surface state of the nanopowder before and after cleaning because a shell-forming material was not used. On the other hand, in the case of Example 3, it can be confirmed that the shell layer was removed and the nickel nanopowder particles were individualized due to washing with di stilled water.

Figure 13:
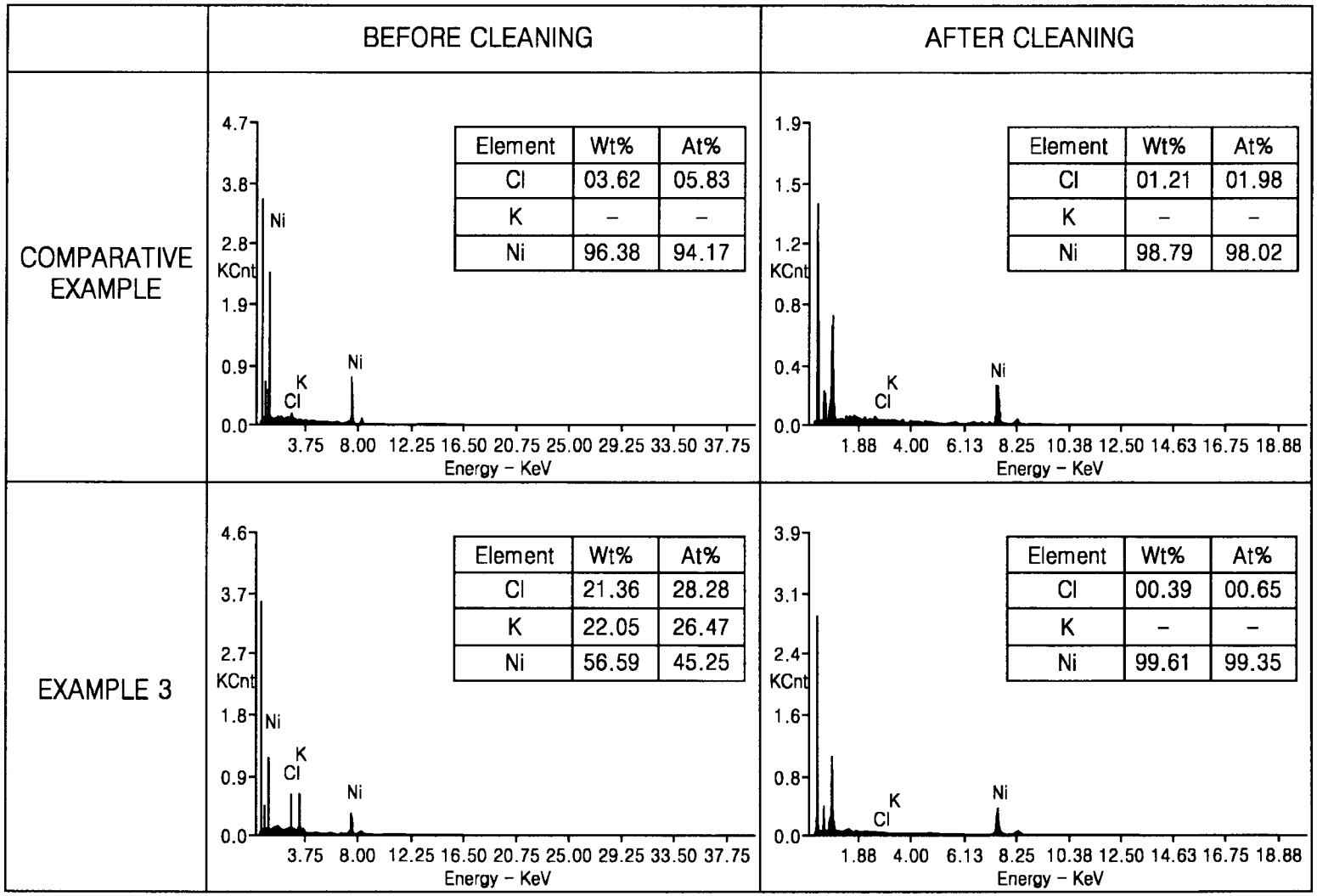
FIG. 13 illustrates the results of EDS analysis after cleaning with distilled water of a nickel nanopowder formed using the method of producing a nickel nanopowder according to the technical idea of the present invention.

FIG. 13 illustrates the results of EDS analysis after cleaning with distilled water of a nickel nanopowder formed using the method of producing a nickel nanopowder according to the technical idea of the present invention.

Referring to FIG. 13, in the case of the comparative example, the content of potassium was not shown because a shell-forming material was not used, and the content of chlorine used to form nickel powder was reduced by cleaning.

In the case of the examples, it can be confirmed that the contents of potassium and chlorine are high because a shell composed of KCl surrounds the nickel core particles before cleaning, but after cleaning, the potassium content is not shown and the chlorine content is very low. Therefore, it can be confirmed that, in the examples, the shell is effectively removed by cleaning to form a nickel nanopowder. The nickel content in the nickel nanopowder was 56.59% by weight before cleaning and 99.61% by weight after cleaning. In the case of the examples, the chlorine content contained in the nickel nanopowder was lower than that of the comparative example.

It will be obvious to those skilled in the art, to which the technical idea of the present invention pertains, that the technical idea of the present invention described above is not limited to the above-described embodiments and the accompanying drawings and various substitutions, modifications, and changes are possible within the scope of the technical idea of the present invention.

The invention claimed is:

1. A method of producing a nickel nanopowder, the method comprising:

providing a nickel salt and a shell-forming material;

nucleating and growing nickel core particles from the nickel salt;

forming a shell layer on surfaces of the nickel core particles using the shell-forming material; and removing the shell layer to form the nickel nanopowder, wherein, in the forming, a free energy of formation of the shell-forming material is smaller than a free energy of formation of the nickel salt.

2. The method according to claim 1, wherein the shell layer induces non-sintering-type coagulation of the nickel core particles, and the non-sintering-type coagulated nickel core particles are individualized as the shell layer is removed, thereby forming the nickel nanopowder.

3. The method according to claim 1, wherein, in the providing, the shell-forming material is provided in a range of 0.4 mmol/L to 2.5 mmol/L in a molar ratio per the volume of an injection gas.

4. The method according to claim 1, wherein, in the nucleating and growing, the nickel salt is reduced using a reducing gas, thereby forming the nickel core particles in a solid phase.

5. The method according to claim 1, wherein, in the forming, a vaporized shell-forming material is precipitated and grown on surfaces of the nickel core particles to form the shell layer.

6. The method according to claim 1, wherein the forming is performed in an area where temperature decreases according to a direction in which the nickel core particles are transported.

7. The method according to claim 1, wherein, in the removing, the shell layer is selectively removed through wet post-processing.

8. The method according to claim 1, wherein the nickel salt comprises at least one of nickel acetate, nickel bromide, nickel carbonate, nickel chloride, nickel fluoride, nickel hydroxide, nickel iodide, nickel nitrate, nickel oxide, nickel phosphate, nickel silicate, nickel sulfate, and nickel sulfide.

9. The method according to claim 1, wherein the shell-forming material comprises a water-soluble metal salt.

10. The method according to claim 1, wherein the shell-forming material comprises at least one of aluminum (Al), barium (Ba), calcium (Ca), chromium (Cr), cobalt (Co), copper (Cu), iron (Fe), lead (Pb), lithium (Li), magnesium (Mg)), manganese (Mn), mercury (Hg), nickel (Ni), potassium (K), rubidium (Rb), silver (Ag), sodium (Na), strontium (Sr), tin (Sn), lanthanum (La), silicon (Si), gallium (Ga), scandium (Sc), titanium (Ti), vanadium (V), zirconium (Zr), yttrium (Y), cadmium (Cd), actinium (Ac), cesium (Cs)), hafnium (Hf) and zinc (Zn), or the shell-forming material comprises at least one of metal acetate, metal bromide, metal carbonate, metal chloride, metal fluoride, metal hydroxide, metal iodide, metal nitrate, metal oxide, metal phosphate, metal silicate, metal sulfate, and metal sulfide.

11. A method of producing a metal nanopowder, the method comprising:

providing a metal salt and a shell-forming material;

nucleating and growing metal core particles from the metal salt;

forming a shell layer on the surface of the metal core particles using the shell-forming material; and removing the shell layer to form the metal nanopowder, wherein, in the forming, a free energy of formation of the shell-forming material is smaller than a free energy of formation of the metal salt.

* * * * *